US006676068B2

(12) United States Patent
Emes

(10) Patent No.: US 6,676,068 B2
(45) Date of Patent: Jan. 13, 2004

(54) SPOOL SUPPORT APPARATUS AND METHOD OF USE OF THE SAME

(76) Inventor: James Emes, Box 351, Slave Lake, Alberta (CA), T0G 2A0

( * ) Notice: Subject to any disclaimer, the term of this patent is extended or adjusted under 35 U.S.C. 154(b) by 0 days.

(21) Appl. No.: 09/998,707

(22) Filed: Nov. 30, 2001

(65) Prior Publication Data

US 2002/0066822 A1 Jun. 6, 2002

(30) Foreign Application Priority Data

Dec. 4, 2000 (CA) ..... 2327406

(51) Int. Cl.[7] ..... B65H 49/28
(52) U.S. Cl. ..... 242/597.7
(58) Field of Search ..... 242/547.7, 406, 242/139

(56) References Cited

U.S. PATENT DOCUMENTS

| | | | | | |
|---|---|---|---|---|---|
| 2,647,704 | A | | 8/1953 | Samler et al. | 242/128 |
| 3,202,380 | A | | 8/1965 | Hosbein | 242/128 |
| 3,625,449 | A | * | 12/1971 | Landsem | 242/597.7 |
| 3,721,394 | A | * | 3/1973 | Reiser | 242/421.3 |
| 3,998,403 | A | | 12/1976 | Kovaleski | 242/129.72 |
| 4,184,647 | A | | 1/1980 | Rourke | 242/54 |
| 4,456,198 | A | * | 6/1984 | Kosch | 242/156.2 |
| 4,465,246 | A | * | 8/1984 | Kosch | 242/156.2 |
| 4,508,291 | A | * | 4/1985 | Kosch | 242/156.2 |
| 4,602,753 | A | * | 7/1986 | Kosch | 242/156.2 |
| 4,681,277 | A | * | 7/1987 | Kosch | 242/156.2 |
| 4,688,741 | A | | 8/1987 | Campbell | 242/128 |
| 4,953,810 | A | | 9/1990 | Stadig | 242/129 |
| 5,100,074 | A | * | 3/1992 | Jones | 242/420.6 |
| 5,497,958 | A | * | 3/1996 | Orf et al. | 242/597.7 |

* cited by examiner

*Primary Examiner*—Kathy Matecki
*Assistant Examiner*—Sang K. Kim
(74) *Attorney, Agent, or Firm*—Davis & Bujold PLLC

(57) ABSTRACT

A spool support apparatus includes a first plate and a second plate. The first plate has a peripheral edge. Fastener receiving openings are spaced about the peripheral edge of the first plate. The second plate is rotatably mounted to the first plate for rotation about a rotational axis. A bearing is disposed between the first plate and the second plate, thereby facilitating relative rotation of the first plate and the second plate when under load from a spool. The first plate of the spool support apparatus is securable by fasteners to an end of a spool with the rotational axis of the spool axially aligned with the rotational axis of the spool support apparatus to turn the spool into a turntable dispensing apparatus.

6 Claims, 4 Drawing Sheets

SPOOL SUPPORT APPARATUS AND METHOD OF USE OF THE SAME

FIELD OF THE INVENTION

The present invention relates to a spool support apparatus and a method of use of the same

BACKGROUND OF THE INVENTION

U.S. Pat. No. 4,953,810 (Stadig) discloses a portable turntable style of wire or cable dispensing apparatus that rotates about a substantially vertical axis. This type of apparatus is an alternative to a reel style of dispensing apparatus that rotate about a substantially horizontal axis.

Heavy gauge cable comes on spools. Depending upon the gauge of cable, a spool containing 300 meters of cable may weigh 800 kilograms or more. Even if the dispensing apparatus of Stadig was substantially increased in size, it would not be practical to transfer that quantity and weight of cable from the manufacturer's spool to the dispensing apparatus.

SUMMARY OF THE INVENTION

What is required is a spool support apparatus and method of use of the same that is better suited for heavy gauge cable.

According to one aspect of the present invention there is provided a spool support apparatus which includes a first plate and a second plate rotatably mounted to the first plate for rotation about a rotational axis. A bearing disposed is between the first plate and the second plate, thereby facilitating relative rotation of the first plate and the second plate when under load. Means is provided for mounting a spool onto one of the first plate or the second plate.

The spool support apparatus, as described above, when secured to a spool turns the spool into a turntable dispensing apparatus. For small spools the means for mounting a spool onto one of the first plate or the second plate is a spindle affixed to the rotational axis of one of the first plate or the second plate. For larger spools, the means for mounting a spool onto one of the first plate or the second plate is by having threaded fasteners pass through openings in one of the first plate or the second plate and penetrate a flanged end of the spool.

According to another aspect of the present invention there is provided a method of use of a spool support apparatus. A first step involves providing a spool having opposed ends with peripheral coil retaining flanges and a rotational axis extending between the opposed ends. A second step involves providing a spool support apparatus as previously described. A third step involves securing the first plate to one of the opposed ends of the spool with the rotational axis of the spool support apparatus substantially axially aligned with the rotational axis of the spool. The first plate is secured using threaded fasteners that have heads and bodies. The heads engage the first plate and the bodies extend through the fastener receiving openings to penetrate the spool. A fourth step involves tipping the spool so that the spool support apparatus underlies and rotatably supports the spool.

According to yet another aspect of the invention there is provided a spool and spool support apparatus combination, as will hereinafter be further described.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
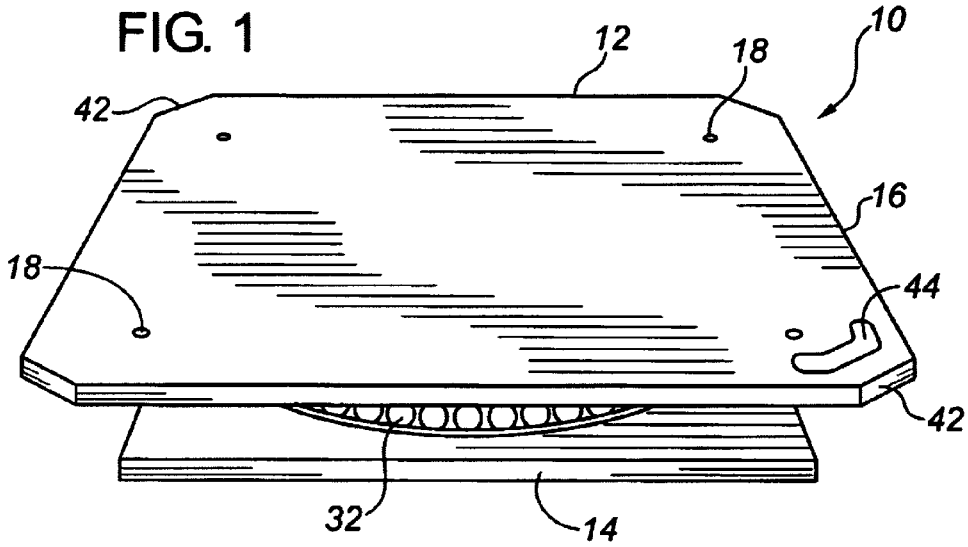
FIG. 1 is a perspective view of a spool support apparatus.

The preferred embodiment, a spool support apparatus generally identified by reference numeral 10, will now be described with reference to FIGS. 1 through 5.

Structure and Relationship of Parts

Figure 2:
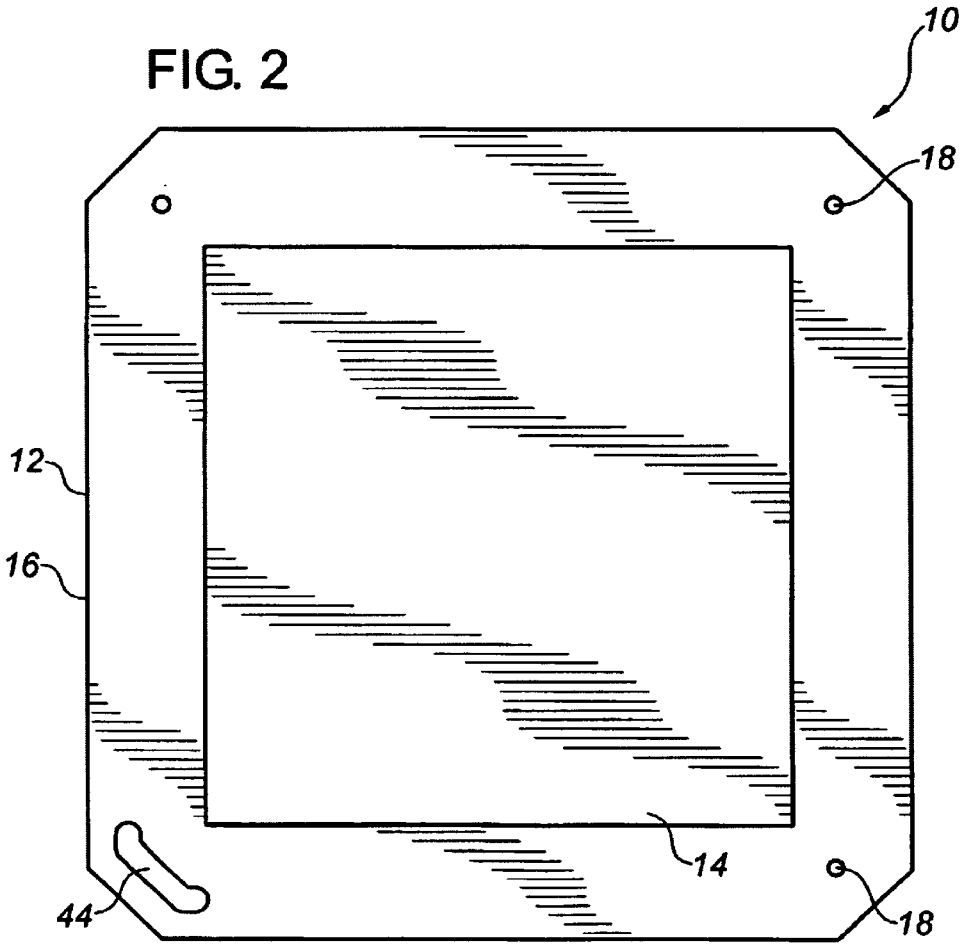
FIG. 2 is bottom view of spool support apparatus illustrated in FIG. 1.
Figure 3:
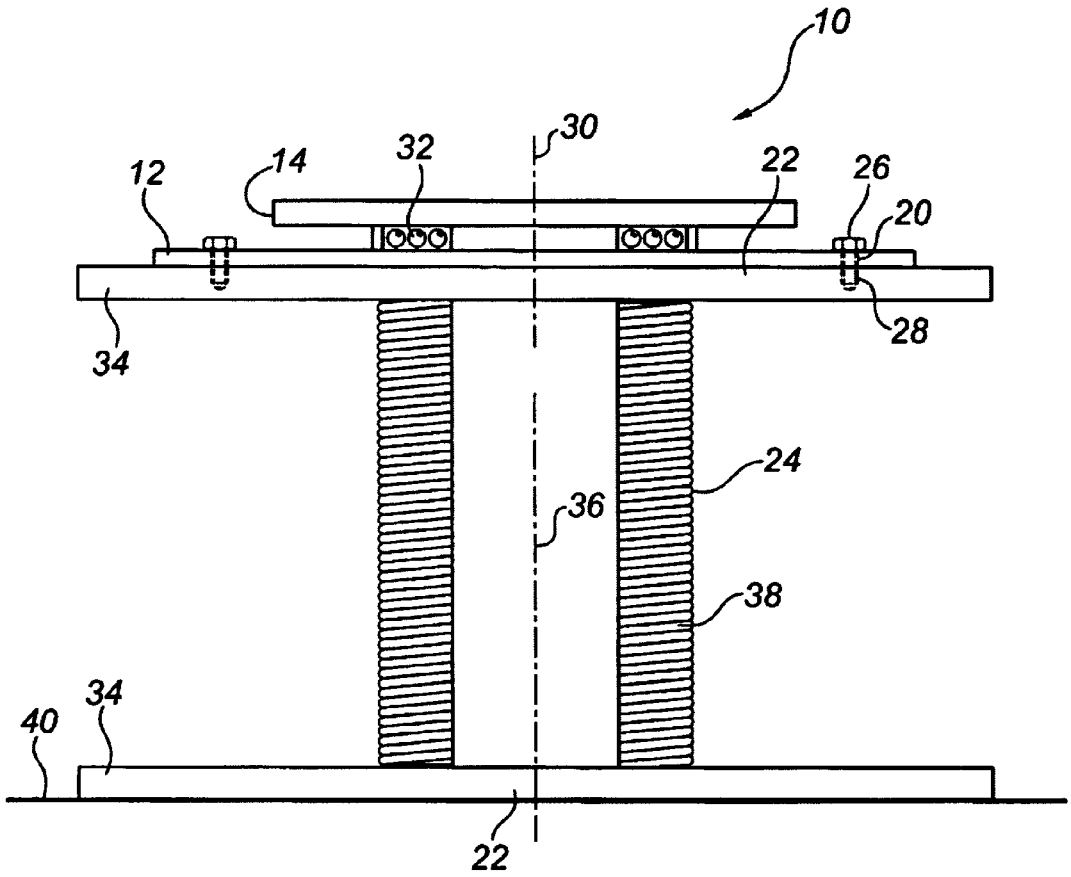
FIG. 3 is a front elevation view in section of spool apparatus illustrated in FIG. 1, mounted on a spool.

Referring to FIG. 1, there is provided a spool support apparatus 10 which includes a first plate 12 and a second plate 14. Referring to FIG. 2, first plate 12 has a peripheral edge 16. Fastener receiving openings 18 are spaced about the peripheral edge 16 of first plate 12. Referring to FIG. 3, threaded fasteners 20 are used to secure first plate 12 to one of opposed ends 22 of a spool 24. Threaded fasteners 20 have heads 26 which engage first plate 12 and bodies 28 that extend through fastener receiving openings 18 and penetrate one of opposed ends 22 of spool 24. Second plate 14 is rotatably mounted to first plate 12 for rotation about a rotational axis 30. A bearing 32 is disposed between first plate 12 and second plate 14, thereby facilitating relative rotation of first plate 12 and second plate 14 when under load from spool 24.

Operation

Figure 4:
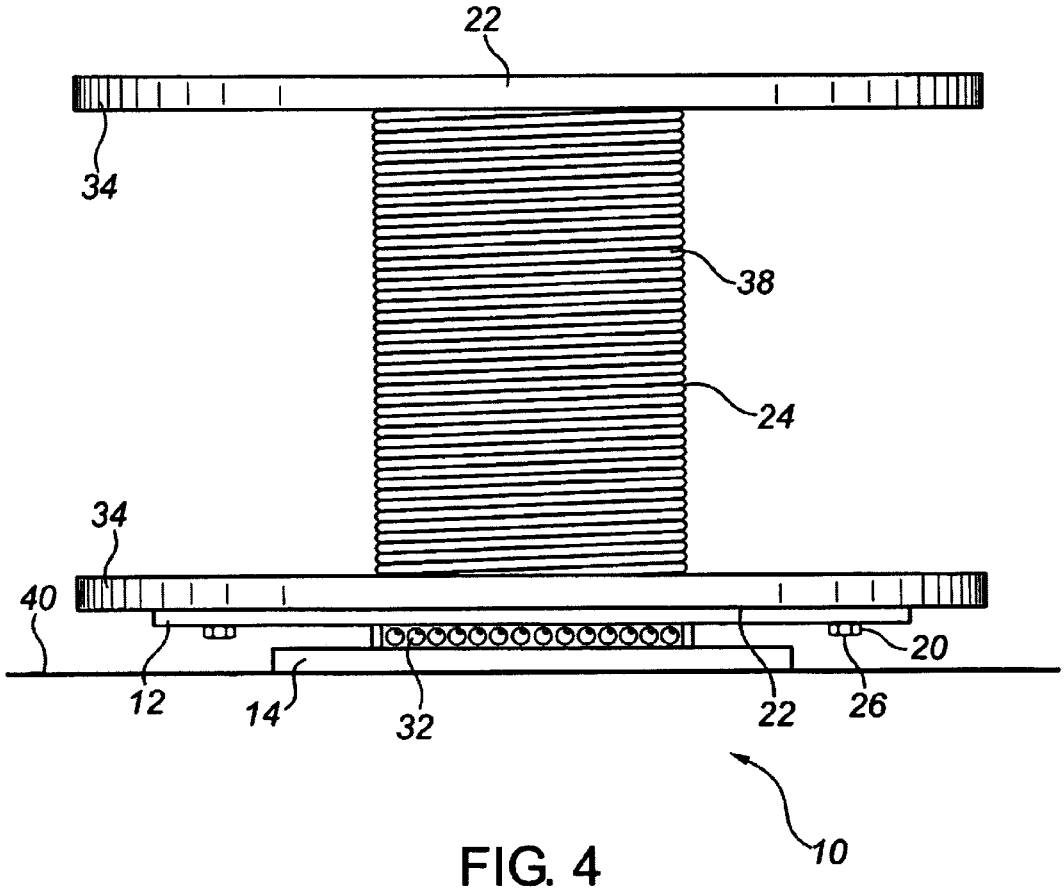
FIG. 4 is a front elevation view of spool support apparatus illustrated in FIG. 1, supporting a spool.

Referring to FIG. 1, a method of use of spool support apparatus 10 includes a first step that involves providing spool 24 that has opposed ends 22 with peripheral coil retaining flanges 34 and a rotational axis 36 extending between opposed ends 22. Coil retaining flanges 34 prevent coiled material 38 from slipping off spool 24 during handling or rotation of spool 24. A second step involves providing spool support apparatus 10 as previously described. Referring to FIG. 3, a third step involves securing first plate 12 to one of opposed ends 22 of spool 24 while spool is resting on a supporting surface 40. Spool apparatus 10 is placed on one of opposed ends 22 of spool 24 such that the rotational axis 30 of spool support apparatus 10 is substantially axially aligned with rotational axis 36 of spool 24. First plate 12 is secured to one of opposed ends 22 of spool 24 using threaded fasteners 20 that have heads 26 and bodies 28. Heads 26 engage first plate 12 and bodies 28 extend through fastener receiving openings 18 to penetrate spool 24. Referring to FIG. 4, a fourth step involves tipping spool 24 so that spool support apparatus 10 now rests on supporting surface 40 while underlying and rotatably supporting spool 24. Spool 24 is then able to rotate on spool support apparatus 10 in order to facilitate the dispensing of coiled material 38 on spool 24. In the illustrated embodiment, first plate 12 has truncated corners 42 to prevent injury or damage when tipping spool 24, however spool support apparatus will function without truncated corners 42. First plate 12 also has a handle opening 44 to facilitate handling of spool support apparatus 10, however it will be appreciated other types of handles can be used. Spool support apparatus 10 will also function without any handle 44.

Figure 5:
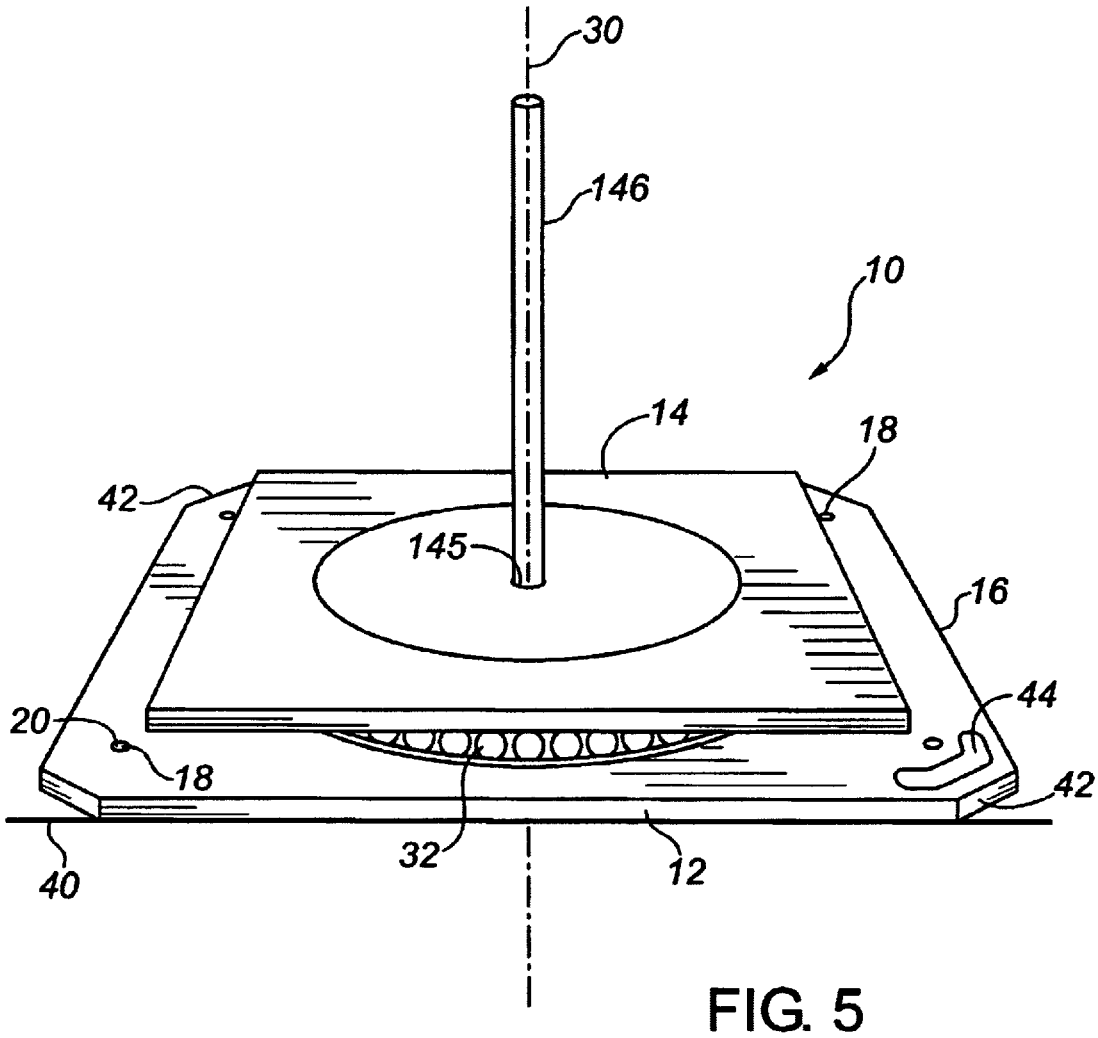
FIG. 5 is a bottom perspective view the spool support apparatus illustrated in FIG. 1.

When spool support apparatus 10 was used with smaller lighter spools, problems were encountered. It was soon determined that a different means had to be developed to maintain the spool in position. It was also determined that with lighter spools, spool support apparatus tended to be pulled across the floor. These problems have been addressed through minor modifications to spool support apparatus 10. Referring to FIG. 5, a hole 145 has been drilled into second plate 14 along rotational axis 30 into which a spindle 146 is inserted. A small spool of wire can be dropped onto spindle 146. Spindle 146 will then maintain the small spool in position during use. Fastener receiving openings 18 provided in first plate 12 allow spool support apparatus to be secured to supporting surface 40, normally the unfinished subfloor, by fasteners 20.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of use of a spool support apparatus, comprising the steps of:

firstly, providing a spool having a core with first and second opposed ends, and the first opposed end of the core fixedly supporting a first peripheral coil retaining flange and the second opposed end of the core fixedly supporting a second peripheral coil retaining flange whereby the fixed first and second peripheral coil retaining flanges are prevented from moving along the core toward and rotating with respect to one another, and a rotational axis of the spool extending through the fixed first and second peripheral coil retaining flanges and the core, and the spool coming from a factory filled with coiled material wrapped around the core;

secondly, the spool support apparatus, having:

a first plate having a peripheral edge;

fastener receiving openings spaced about the peripheral edge of the first plate;

a second plate rotatably mounted to the first plate for rotation about the rotational axis of the support apparatus;

a bearing disposed between the first plate and the second plate, thereby facilitating relative rotation of the first plate and the second plate;

thirdly, resting the spool on one of the fixed first and second peripheral coil retaining flanges and securing the first plate to the other of the fixed first and second peripheral coil retaining flanges of the spool with threaded fasteners having heads and bodies, the heads engaging the first plate and the bodies extending through the fastener receiving openings to penetrate one of the first and second fixed peripheral coil retaining flanges, and the rotational axis of the spool support apparatus being substantially axially aligned with the rotational axis of the spool; and fourthly, tipping the spool so that the spool support apparatus underlies and rotatably supports the spool to facilitate dispensing of the coiled material from the spool.

2. The method according to claim 1, comprising the step of making the first plate larger than the second plate such that the peripheral edge of the first plate is spaced further radially away from the rotational axis of the support apparatus than a peripheral edge of the second plate to facilitate attachment of the threaded fasteners.

3. In combination:

a spool having a core with first and second opposed ends, the first opposed end of the core fixedly supporting a first peripheral coil retaining flange and the second opposed end of the core fixedly supporting a second peripheral coil retaining flange whereby the fixed first and second peripheral coil retaining flanges are prevented from moving along the core toward and rotating with respect to one another, and a rotational axis of the spool extending through the fixed first and second peripheral coil retaining flanges and the core, and the spool coming from a factory filled with coiled material wrapped around the core;

a spool support apparatus, comprising:

a first plate having a peripheral edge;

fastener receiving openings spaced about the peripheral edge of the first plate;

a second plate rotatably mounted to the first plate for rotation about the rotational axis of the support apparatus;

a bearing disposed between the first plate and the second plate, thereby facilitating relative rotation of the first plate and the second plate;

the first plate being secured to one of fixed first and second peripheral coil retaining flanges of the spool with threaded fasteners having heads and bodies while the spool is resting on the other of the fixed first and second peripheral coil retaining flanges, the heads engaging the first plate and the bodies extending through the fastener receiving openings to penetrate one of the first and second fixed peripheral coil retaining flanges, and the rotational axis of the spool support apparatus being substantially axially aligned with the rotational axis of the spool.

4. The combination according to claim 3, wherein the first plate is larger than the second plate such that the peripheral edge of the first plate is spaced further radially away from the rotational axis of the support apparatus than a peripheral edge of the second plate to facilitate attachment of the threaded fasteners.

5. A method of using of a spool support apparatus comprising a first plate, a second plate rotatable relative to the first plate about a rotational axis of the spool support apparatus, and a bearing disposed between the first plate and the second plate to facilitate relative rotation between the first plate and the second plate about the spool support apparatus rotational axis, the method comprising the steps of:

providing a spool with first and second opposed ends, the first opposed end of the core fixedly supporting a first peripheral coil retaining flange and the second opposed end of the core fixedly supporting a second peripheral coil retaining flange whereby the fixed first and second peripheral coil retaining flanges are prevented from moving along the core toward and rotating with respect to one another, and the spool supporting a coiled material to be dispensed and defining a spool rotational axis;

securing one of the fixed first and second peripheral coil retaining flanges to the first plate via at least one fastener, while the spool is resting on the other of the fixed first and second peripheral coil retaining flanges, so that the spool support apparatus rotational axis is substantially axially aligned with the spool rotational axis; and flipping the spool and the spool support apparatus over from the other of the fixed first and second peripheral coil retaining flanges the, following securing one of the pair of spaced apart coil retaining flanges to the first plate, so that the second plate engages a supporting surface and the first plate and the spool are spaced from the supporting surface surface, whereby the spool and the first plate are both rotatable relative to the second plate and the supporting surface to facilitate dispensing of the coiled material from the spool.

6. The method according to claim 5, further comprising the step of making the first plate larger than the second plate such that the peripheral edge of the first plate is spaced further radially away from the spool support apparatus rotational axis than a peripheral edge of the second plate to facilitate attachment of the threaded fasteners.

* * * * *